United States Patent [19]

Broadhurst

[11] Patent Number: 4,898,659

[45] Date of Patent: Feb. 6, 1990

[54] MULTI-POINT COLD SOLVENT INJECTION IN SCRAPED SURFACE DEWAXING CHILLERS

[75] Inventor: Thomas E. Broadhurst, Sarnia, Canada

[73] Assignee: Exxon Research and Engineering Company, Florham Park, N.J.

[21] Appl. No.: 171,675

[22] Filed: Mar. 21, 1988

[51] Int. Cl.[4] ..... C10G 43/08

[52] U.S. Cl. ..... 208/33; 208/37

[58] Field of Search ..... 208/33, 37

[56] References Cited

U.S. PATENT DOCUMENTS

| | | | |
|---|---|---|---|
| 2,410,483 | 11/1946 | Dons et al. | 208/33 |
| 2,612,465 | 9/1952 | Kiersted, Jr. et al. | 208/33 |
| 3,775,288 | 11/1973 | Eagen et al. | 208/33 |
| 3,871,991 | 3/1975 | Shaw | 208/33 |
| 4,115,242 | 9/1978 | Sequeira et al. | 208/33 |
| 4,146,461 | 3/1979 | Broadhurst et al. | 208/33 |
| 4,334,978 | 6/1982 | Broadhurst | 208/33 |
| 4,356,080 | 10/1982 | Pullen et al. | 208/31 |

*Primary Examiner*—Glenn Caldarola
*Attorney, Agent, or Firm*—Joseph J. Allocca

[57] ABSTRACT

Solvent dewaxing of waxy hydrocarbon oils using scraped surface chillers is improved by injecting cold solvent into the scraped surface chillers at multiple points to augment the indirect chilling occurring in said scraped surface chillers. In utilizing this multi-point cold solvent injecting process it is important to control the $\Delta T$ occurring at each injection point within each chiller bank across the entire chiller train.

The $\Delta T$ at each injection point attributable only to cold solvent injection must be equal if one is to secure the benefit of the present invention which is an improved liquids/solids ratio without deterioration of the feed filter rate.

Preferably, to avoid any possible deterioration of filter rate and/or liquids solids, the cold solvent injection should be completed prior to the slurry in the scraped surface chiller train experiences any shock chilling.

3 Claims, No Drawings

MULTI-POINT COLD SOLVENT INJECTION IN SCRAPED SURFACE DEWAXING CHILLERS

BRIEF DESCRIPTION OF THE INVENTION

Solvent dewaxing of waxy hydrocarbon oils using scraped surface chillers is improved by injecting cold solvent into the scraped surface chillers at multiple points to augment the indirect chilling occurring in said scraped surface chillers. In utilizing this multi-point cold solvent injection process it is important to control the $\Delta T$ occurring at each injection point within each chiller bank across the entire chiller train.

In employing multi-point cold solvent injection in scraped surface chilling either cold fresh solvent or cold second stage filtrate or a combination of both may be used as the cold injected solvent.

The $\Delta T$ at each injection point must be controlled if one is to secure the benefit of the present invention which is an improved liquids/solids ratio without deterioration of the feed filter rate.

To achieve this desired result it has been discovered that the $\Delta T$ at each injection point attributable only to cold solvent injection must be equal.

BACKGROUND OF THE INVENTION

Waxy hydrocarbon oils have long been dewaxed to improve their pour points and to make them useful as basestock oils for lubricating oils and other specialty oils such as refrigeration oils, white oils, turbine oils, electrical insulating oils, etc.

The wax is removed from said oils by chilling the oils to induce wax crystallization. With very light oils, this chilling can be practiced simply by reducing the temperature of the oils. However, with heavier oils it is necessary to utilize various solvents both as diluents to render the oils more manageable and also as a means of temperature reduction, e.g., through the use of cold solvents.

In incremental dilution dewaxing, solvent is added in increments to the waxy oil and the mixture is indirectly chilled in double pipe heat exchangers, the internal surface of which is scraped using a scraper blade to prevent wax build up.

Alternatively, cold solvent can be directly injected into the waxy oil under conditions of high agitation to prevent shock chilling. A preferred embodiment is disclosed in U.S. Pat. No. 3,773,650, which describes a "dilution chilling" dewaxing method in which a waxy oil stock is introduced into a cooling zone divided into a plurality of stages. Dewaxing solvent is introduced into the cooling zone at a plurality of points along the cooling zone, coming into contact with the oil and forming a wax-oil-solvent mixture.

High levels of agitation are provided in at least a portion of the solvent-containing stages, thereby providing substantially instantaneous mixing of solvent and oil, i.e., within a second or less. As the oil passes through the cooling zone, it is cooled to a temperature sufficient to precipitate at least a portion of the wax therefrom, resulting in the formation of a wax slurry wherein the wax has a unique crystal structure with markedly superior filtering characteristics and wherein the wax slurry has a relatively high filtration rate and good dewaxed oil yields are obtained.

Alternatively, the procedure of U.S. Pat. No. 3,775,288 may be employed wherein lubricating oil fractions are dewaxed by contacting them with successive increments of cold solvent at a plurality of points along a vertical tower while maintaining a zone of intense agitation at each point of solvent injection so that substantially instantaneous mixing occurs at each point, continuing the chilling by means of said cold solvent injection until a temperature greater than the filtration temperature but less than about 35° F. above the filtering temperature is reached and completing the cooling of oil to the filtration temperature in a scraped surface chiller.

In U.S. Pat. No. 4,146,461, an improved dilution chilling dewaxing process is described in which the temperature profile of the chilling tower is modified. In that process, waxy oils are solvent dewaxed by contacting them with successive increments of cold dewaxing solvent at a plurality of points along the height of a vertical tower divided into a plurality of stages while agitating the oil-solvent mixture in each stage to provide substantially instantaneous mixing of waxy oil and solvent thereby precipitating wax from the oil while avoiding shock chilling. The improvement resides in adjusting the cold solvent addition to each stage in a manner so as to modify the temperature profile along the tower to ensure that the temperature drop per stage in the initial stages in which wax precipitation occurs is greater than the temperature drop per stage in the final or later stage in which wax precipitation occurs.

U.S. Pat. No. 4,356,080 describes the solvent deoiling of slack waxes (and the separation of wax from oil in general) using scraped surface chillers into which cold solvent is injected into conduits transporting the waxy oil using injectors which produce turbulent mixing such that substantially uniform and instantaneous mixing of the injected solvent and the waxy oil is effected.

THE PRESENT INVENTION

It has been discovered and forms the basis of the present disclosure that solvent dewaxing using scraped surface chilling employing the injection of cold dewaxing solvent into the scraped surface chiller to augment the chilling normally practiced in such chillers can be improved by exercising careful control over the $\Delta T$ at each injection point, so that the $\Delta T$, due to cold solvent injection, at any one injection point is substantially the same as the $\Delta T$ at any other injection point across the entire chiller train.

The cold solvent injected at each injection point into each chiller bank across the chiller train may be fresh cold solvent or second stage filtrate or a mixture of the two. Appropriate solvents are any of the typical normally liquid dewaxing solvents, for example, ketones having 3 to 6 carbon (e.g., acetone, methyl ethyl ketone, methyl isobutyl ketone) and mixtures thereof, (such as MEK/MIBK), $C_6$–$C_{10}$ aromatic hydrocarbons such as benzene, toluene, mixtures of ketones and aromatics such as MEK/toluene, halogenated hydrocarbons such as tri-chloroethane etc, ethers and as methyl tert-butylether and other such dewaxing solvents. Cold fresh solvents will typically have a temperature of about −5° to +20° F. while second stage filtrate will typically have a temperature of about +4° to +24° F.

It has been found that it is not enough simply to inject cold solvent into the scraped surface apparatus albeit at multiple points if one is seeking to improve the dewaxing process. Indeed, failure to exercise control over the solvent injection process can have a detrimental effect on feed filter rate.

In order to achieve an improved dewaxing process, one which exhibits an improvement in the liquids to solids ratio while at the same time exhibiting a negligible degrading effect on the feed filter ratio (if any) it has been found necessary to carefully control the ΔT at each injection point as well as the temperature drop across each bank.

When practicing cold solvent injection into scraped surface chillers it is necessary to note that chilling is being affected by two different techniques. One is the normal indirect chilling effected by circulating a cold solvent through the shell of the double pipe heat exchanger. The other chilling is the direct chilling effected by the injection of the cold solvent directly into the waxy-oil in the scraped surface chiller.

In the process of the present invention the indirect chiller is operated in its normal configuration, that is, no change is made in the cold solvent temperature or flow rate through the double wall heat exchanger. The only change in operation is the provision for cold solvent injection directly into the scraped surface environment. Such direct cold solvent injection in each bank of scraped surface chillers is effected using multiple injection points. The ΔT across each bank will, therefore, be a function of the number of injection points and the ΔT at each such point. The ΔT at each injection point is a single temperature and can be selected from the range between 1° to 6° F., preferably 2° to 5° F. and is most preferably about 3° F.

The multi-point injection of cold solvent into scraped surface chillers can be practiced either as the sole means of wax precipitation or as part of the process described in U.S. Pat. No. 3,775,288. In such an embodiment waxy oil fractions are dewaxed by contacting them with successive increments of cold solvent introduced into a chilling zone at a plurality of points along a vertical tower while maintaining a zone of intense agitation at each stage of solvent injection so that substantially instantaneous mixing occurs within each stage in which cold solvent is added to the waxy oil. Such chilling by cold solvent injected into the zones of intense agitation is continued until a temperature greater than the filtration temperature but less than about 35° F. above the filtration temperature is reached; chilling to the filtration temperature is completed in scraped surface chillers. The multi point injection of cold solvent into scraped surface chillers of the present invention can be substituted for the traditional scraped surface chilling described in U.S. Pat. No. 3,775,288.

The process of the present invention can be better understood by reference to the following example which is offered solely for explanation and is not to be interpreted as a limitation.

EXAMPLE

A 600N lube oil dewaxer raffinate, extracted using NMP, was dewaxed using scraped surface chillers under a variety of conditions to demonstrate the cold solvent injection process of the present invention.

A chiller train of 6 scraped surface chillers, the last 2 of which are shock chillers which used propane as the indirect chilling medium was employed. The individual banks of chillers within the chilling train are identified as banks A, B, C, D, E and F respectively.

110 barrels per hour of 600N oil was fed to the chilling train. The scraped surface chillers A–D were indirectly chilled using cold primary filtrate at an inlet temperature of 20° F. in standard counter current flow through the shell side of the chiller banks.

Five cases were investigated using this configuration. In each case a base line was established in which the chiller train was operated using normal solvent dilution and no cold solvent injection. Normal solvent dilution constituted 45 barrels per hour of solvent into the junction between chillers B & C and 88 barrels per hour of solvent into the junction between D & E. This dilution solvent is injected at a temperature approximately equal to the temperature of the slurry a the point of addition.

In Case 1 base line dilution solvent was replaced using cold solvent injected in 2 batches into the chiller train at chiller banks B and D using 6 injector points at each bank with no effort being made to control the ΔT at each injection point. The cold solvent injected into bank B constituted 45 barrels per hour and 88 barrels per hour into chiller D.

In Case 2 cold solvent was injected into chiller banks B, C and D (again using 6 injection points at each bank) with the rate of injection controlled so as to obtain an equal ΔT of between 2° to 3° F. at each injection point.

In Case 3 cold solvent was injected into chillers bank B, C, D and E (using 6 injections at each bank). The rate of solvent injection at each injection point was controlled so as to obtain an equal ΔT of about 2° F. at each point. It is to be noted that in this case cold solvent was injected into a shock chiller bank, bank E.

In Case 4 cold solvent was injected into chiller banks B, C and D. In this case, however, injection was controlled so as to obtain equal volumes of solvent injected into each bank to achieve a total dilution of 1 vol. solvent/vol. of feed.

In Case 5 cold solvent was injected into chiller banks B, C, D and E. As in Case 4, injection was controlled so as to obtain equal volumes of solvent injected into each bank to achieve a total dilution of 1 vol. of solvent/vol. of feed.

The results of these 5 Cases are presented below which compare the filter rate in $M^3/m^2$ day in each case with a companion base case and liquids/solids (w/w) in each case with a companion base case.

| Feed filter rate | Base Case | Cold Solvent Injection |
|---|---|---|
| Case 1 | 3.71 | 3.53 |
| Case 2 | 3.42 | 3.41 |
| Case 3 | 3.61 | 3.32 |
| Case 4 | 3.12 | 3.10 |
| Case 5 | 3.64 | 3.21 |
| **Liquids/Solids (w/w)** | **Base Case** | **Cold Solvent Injection** |
| Case 1 | 5.04 | 4.57 |
| Case 2 | 5.40 | 4.85 |
| Case 3 | 5.47 | 4.74 |
| Case 4 | 4.72 | 4.78 |
| Case 5 | 5.63 | 4.83 |

From a review of the above it is apparent that only in Case 2 when the ΔT at each injection point is equal is an improvement in liquids/solids achieved without experiencing a reduction in feed filter rate.

In Case 3, while the ΔT at each injection point was equal, injection of cold solvent into Chiller Bank E, a shock chiller was detrimental to filter rate, and is not a preferred case.

What is claimed is:

1. In the solvent dewaxing of waxy hydrocarbon oils using indirectly cooled scraped surface chillers the improvement comprising injecting cold dewaxing solvent into the scraped surface chillers at multiple points to form a wax/oil/solvent slurry and controlling the $\Delta T$ occurring at each injection point within each chiller bank across the entire chiller train, so that the $\Delta T$ at each injection point attributable only to cold solvent injection is equal.

2. The method of claim 1 wherein cold solvent injection into the scraped surface chiller train is essentially completed before the wax/oil/solvent slurry experiences any shock chilling.

3. The method of claim 1 wherein the cold solvent injected into the scraped surface chiller train is fresh solvent, second stage filtrate or a combination of both.

* * * * *